US006755376B1

(12) United States Patent
Broberg

(10) Patent No.: US 6,755,376 B1
(45) Date of Patent: Jun. 29, 2004

(54) DUAL CONTROL HORN

(76) Inventor: James Broberg, 2819 Oak Ridge Rd., Crystal Lake, IL (US) 60012

( * ) Notice: Subject to any disclaimer, the term of this patent is extended or adjusted under 35 U.S.C. 154(b) by 0 days.

(21) Appl. No.: 10/617,135

(22) Filed: Jul. 10, 2003

(51) Int. Cl.[7] ..... B64C 13/28

(52) U.S. Cl. ..... 244/75 R; 244/221; 244/232; 244/87; 446/66; 403/112

(58) Field of Search ..... 244/189, 221, 244/232, 234, 87, 88, 89, 231, 75 R; 446/57, 34, 56, 66; 403/110, 196, 373, 385, 112, 113, 114, 115, 116, 117

(56) References Cited

U.S. PATENT DOCUMENTS

| | | | | | |
|---|---|---|---|---|---|
| 2,044,108 | A | * | 6/1936 | Sinquefield | 244/48 |
| 2,257,940 | A | * | 10/1941 | Dornier | 244/53 R |
| 2,277,378 | A | * | 3/1942 | Wells | 244/223 |
| 2,500,689 | A | * | 3/1950 | Kendrick | 244/87 |
| 2,652,995 | A | * | 9/1953 | Swain et al. | 244/231 |
| 3,033,596 | A | * | 5/1962 | Pearring | 285/261 |
| 3,072,426 | A | * | 1/1963 | Gilbert | 403/115 |

* cited by examiner

*Primary Examiner*—Michael J. Carone
*Assistant Examiner*—Gabriel S. Sukman
(74) *Attorney, Agent, or Firm*—Mathew R. P. Perrone, Jr.

(57) ABSTRACT

The present invention concerns a control arm that may be used to control the movement of a component of a radio controlled vehicle having a center line. The control arm includes a threaded rod as well as first and second base members. The base members are positionable on opposing sides of the component. Each of the base members has a planar surface and an opposingly located raised section that has an outer surface that is partially spherical in shape. An opening is located in each of the base members which extends through the base members. Also provided are opposingly located locking members, each of the locking members has a cavity shaped to engage the spherical section of the clamping member and an internally threaded bore which coacts with the threaded rod. The coaction between the threaded portions creates a biasing force which urges the base members against the components. The engagement of the cavity and spherical section permit the base members to be moveable with respect to the locking members so as to maintain the rod perpendicular to the centerline of the component.

3 Claims, 2 Drawing Sheets

DUAL CONTROL HORN

BACKGROUND OF THE INVENTION

The present invention relates to a novel dual control horn for use with remote controlled apparatus including, but not limited to, aircraft, watercraft, and land vehicles. More specifically, the present invention provides two opposingly located base members that maintain a control rod in a position that is perpendicular to a central axis no matter the angle of the outer surface of the component to be controlled.

SUMMARY OF THE INVENTION

In the remote control field, control arms and the like are often used to control the movement of various components or pieces of equipment. For example, a control rod will often be used to control the movement of a rudder used on a remote control airplane. However, because the outer surface of the rudder is angled, securing a control arm so that it is perpendicular to the center line of the component is often difficult because the clamping members used with a control arm are only designed to work on flat surfaces. Thus, when an angled surface is encountered, the clamping members cannot either fully engage the surface or, as is often the case, dig into the surface. Alternatively, shims or inserts are often used to overcome this problem.

The present invention permits use with an angled surface by providing clamping members that have movable portions. The moveable sections conform to the angle of the support surface so as to maintain the control arm perpendicular to the center line of the component.

DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

As shown in FIGS. 1–5, the present invention concerns a control arm 10 having a threaded rod 12, two base members 20 and 22. Also provided are locking members 30 and 32.

Figure 5:
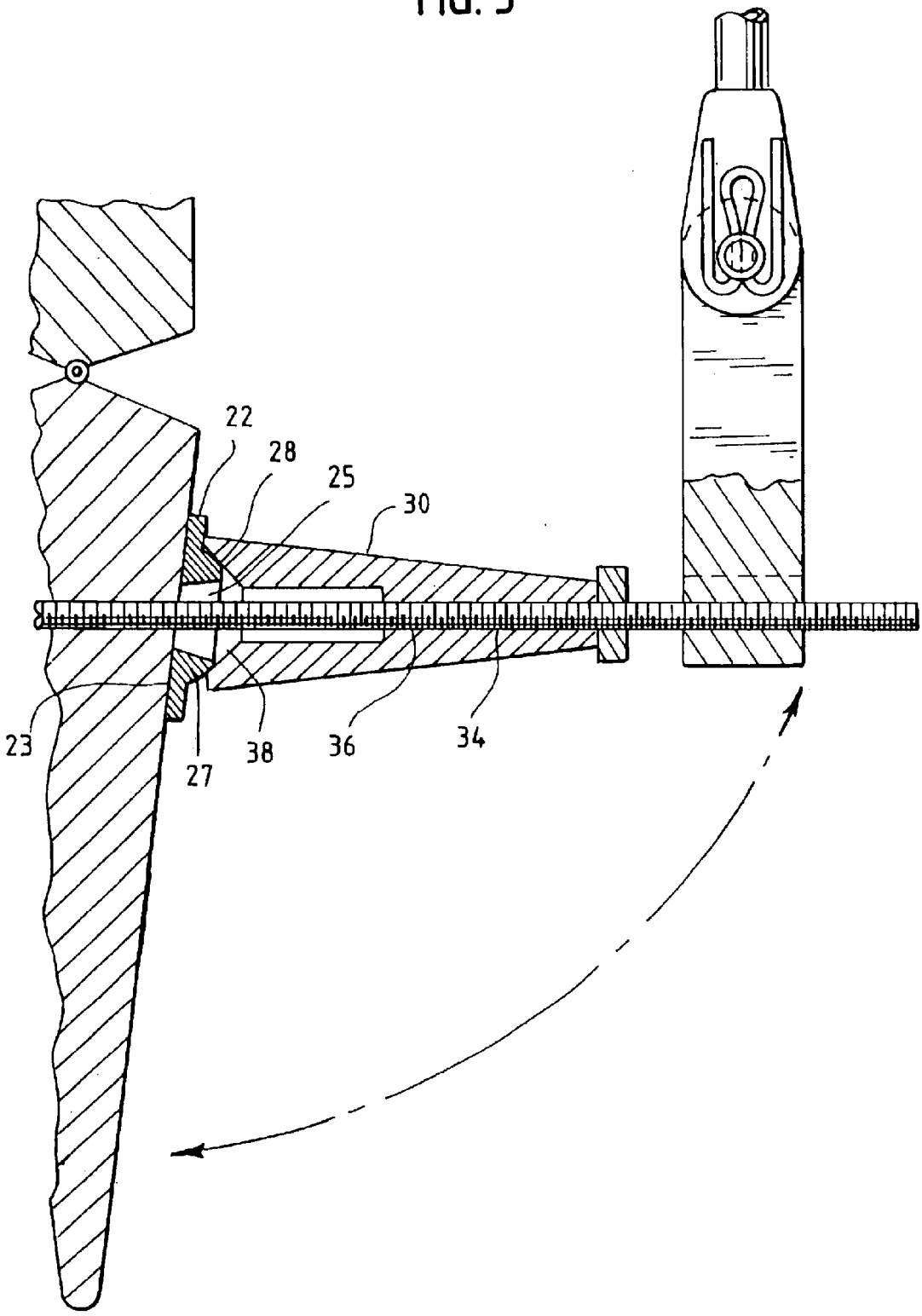
FIG. 5 is a partial exploded view of the present invention.

As shown in FIG. 5, member 30 includes internal threads 34 located in bore 36. Also provided is a cavity 38 which is shaped to complement the outer surface 28 of member 22. Member 32 is similar in design. It includes internal threads located in a bore that terminates in cavity 37. As indicated above, cavity 37 is shaped to complement the outer surface 29 of clamping member 20.

Member 20 includes a planar surface 43 and a raised section 47 which may include a partially spherical outer surface 29. Extending through clamping member 20 is an opening which increases in size from the planar surface to the outer surface.

In use, rod 12 is first place through a component 100 of radio controlled equipment 102. In this example, the equipment 102 is an airplane and component 100 may be a rudder. However, other equipment and components will work with the present invention as well.

Figure 1:
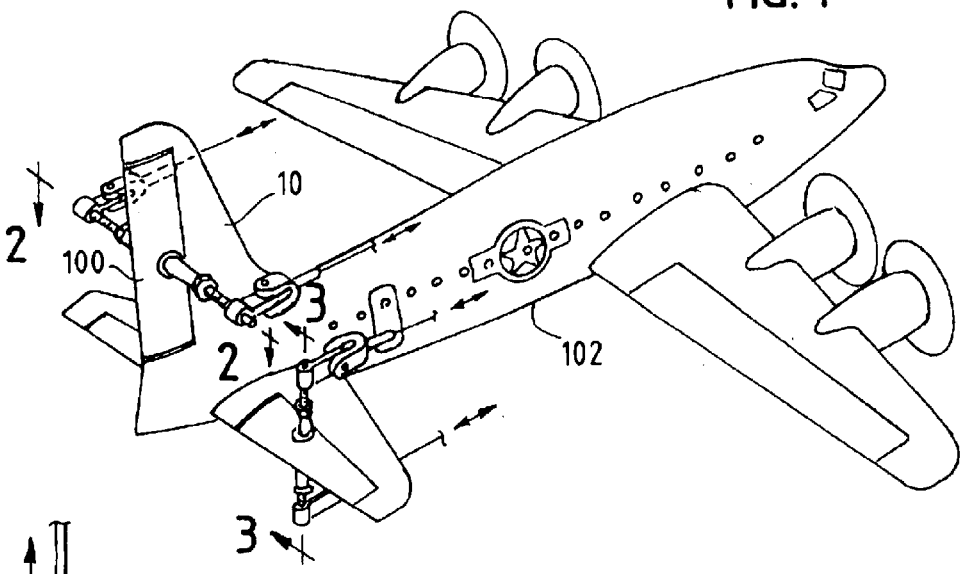
FIG. 1 is a perspective view with portions removed to reveal various aspects of the invention.
Figure 2:
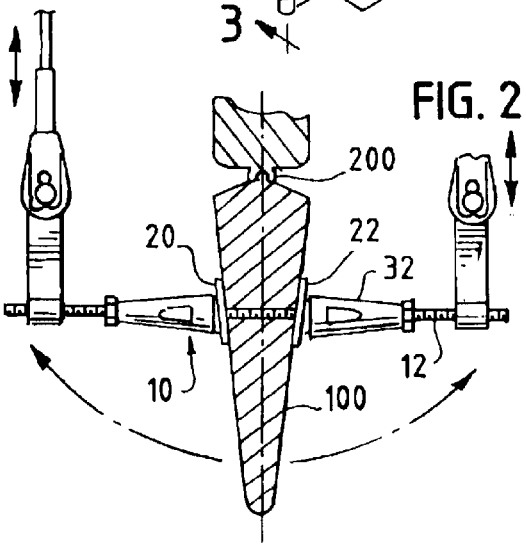
FIG. 2 is a partial sectional view taken along line 2—2.
Figure 3:
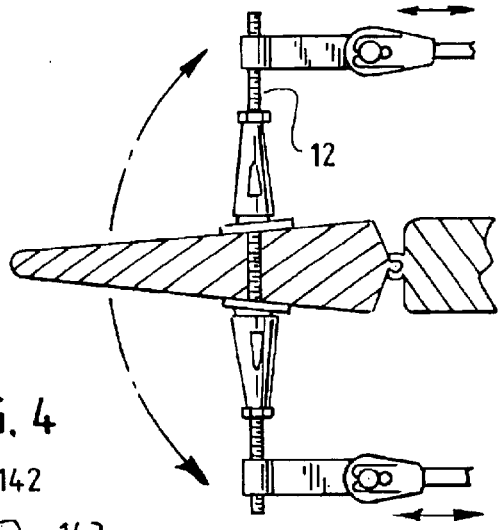
FIG. 3 is a partial sectional view taken along line 3—3.
Figure 4:
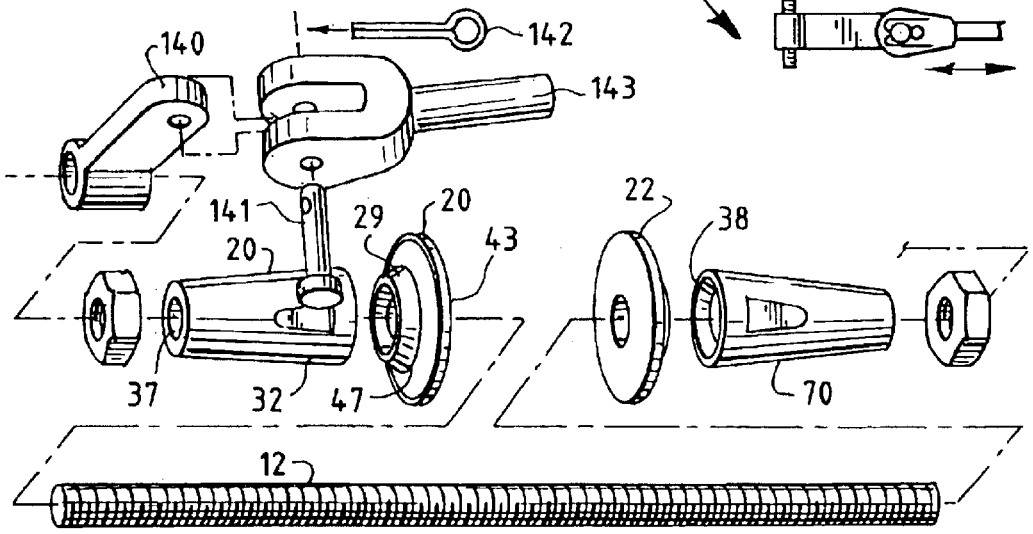
FIG. 4 is an exploded view of the present invention.

Once rod 12 is in position, members 20 and 22 are inserted over threaded rod 10 as shown in FIGS. 1–3. Next, members 30 and 32 are threaded onto the rod. As the members 30 and 32 engage the members 20 and 22, a biasing force is generated which urges the members 20 and 22 against the component. This secures the control arm to the component. As also shown in FIGS. 1, 2 and 5, the interaction between the spherical outer surface of the base members 20 and 22 and cavity or socket of the locking members 30 and 32 permits members 20 and 22 to move with respect to the locking members. This, in turn, permits the planar surface to change to an angle that conforms to the angle of the component without requiring the angle of the rod to be changed. As shown in FIG. 2, this permits rod 12 to maintain a perpendicular alignment with respect to the centerline 200 of component 100 even though the outer surfaces which are engaged by the clamping members are not perpendicular to the centerline. The tapered shape of the opening 25 further permits the clamping members to move with respect to the locking members by eliminating interference with rod 12. Lastly, the control arm may be connected through the use of locking clip components 140–143 as is well known to those of skill in the art.

While the preferred embodiments of the present invention have been illustrated and described, it will be understood by those of ordinary skill in the art that changes and other modifications can be made without departing from the invention in its broader aspects. Various features of the present invention are set forth in the following claims.

What is claimed is:

1. An apparatus for mounting to and controlling the movement of a component of a radio controlled vehicle having a center line comprising:

a threaded rod;

first and second base members positionable on opposing sides of the component;

each of said base members having a planar surface and an opposingly located raised section that has an outer surface that is partially spherical in shape;

an opening in each of said base members, said opening extends through said base members;

opposingly located locking members, each of said locking members having a cavity shaped to engage the spherical section of said base member and an internally threaded bore which coacts with said threaded rod to create a biasing force which urges said base member against the components;

said engagement of said cavity and spherical section permit said base members to be moveable with respect to said locking members so as to maintain said rod perpendicular to the centerline of the component.

2. The apparatus of claim 1 wherein said opening increases in size from said planar section through the raised section.

3. The apparatus of claim 1 wherein said cavity has a shape which complements said spherical portion.

* * * * *